US009388030B2

(12) United States Patent
Barbolini

(10) Patent No.: US 9,388,030 B2
(45) Date of Patent: Jul. 12, 2016

(54) DEVICE FOR PROCESSING A PRODUCT, COMPRISING AN ELEMENT FOR PROCESSING THE PRODUCT AN APPARATUS FOR MOVING A PROCESSING ELEMENT

(75) Inventor: Andrea Barbolini, Pianoro BO (IT)

(73) Assignee: Schneider Electric Automation GmbH, Marktheidenfeld (DE)

( * ) Notice: Subject to any disclaimer, the term of this patent is extended or adjusted under 35 U.S.C. 154(b) by 733 days.

(21) Appl. No.: 13/695,951

(22) PCT Filed: Mar. 5, 2011

(86) PCT No.: PCT/DE2011/000240

§ 371 (c)(1), (2), (4) Date: Dec. 3, 2012

(87) PCT Pub. No.: WO2011/137882

PCT Pub. Date: Nov. 10, 2011

(65) Prior Publication Data

US 2013/0205715 A1 Aug. 15, 2013

(30) Foreign Application Priority Data

May 3, 2010 (IT) ..... BO2010A0275

(51) Int. Cl.
*B67B 3/20* (2006.01)

(52) U.S. Cl.
CPC ..... *B67B 3/20* (2013.01); *B67B 3/2033* (2013.01); *B67B 3/2073* (2013.01)

(58) Field of Classification Search
CPC ..... B67B 3/20; B67B 3/2013; B67B 3/2033; B67B 3/206; B67B 3/2066; B67B 3/26; B67B 3/261; B67B 3/2073
USPC ..... 53/75, 317, 331.5
See application file for complete search history.

(56) References Cited

U.S. PATENT DOCUMENTS 3,151,426 A 10/1964 Pechmann
4,222,214 A * 9/1980 Schultz et al. ..... 53/309

(Continued)

FOREIGN PATENT DOCUMENTS

EP 1 757 555 A1 2/2007
EP 1 772 421 A1 4/2007

(Continued)

OTHER PUBLICATIONS

International Search Report (with English translation) for PCT Application No. PCT/DE2011/000240, dated Aug. 3, 2011, 10 pages.

*Primary Examiner* — Thanh Truong
*Assistant Examiner* — Dianne Mitchell
(74) *Attorney, Agent, or Firm* — Westman, Champlin & Koehler, P.A.

(57) ABSTRACT

The device for processing a product has an element for processing the product and in particular the form of a device that is suitable for connecting a closure element to a container. The device contains means for receiving the product, means for advancing the product, and means for advancing the processing element that is supported on a corresponding shaft. The device contains means that are suitable for moving the carrier shaft of the processing element in the axial direction and means that are suitable for driving the processing element so that the processing element performs a processing rotation, said means acting on the carrier shaft of the processing element in such a way that the means are coordinated with each other.

49 Claims, 3 Drawing Sheets

(56) References Cited

U.S. PATENT DOCUMENTS

Figure 1:
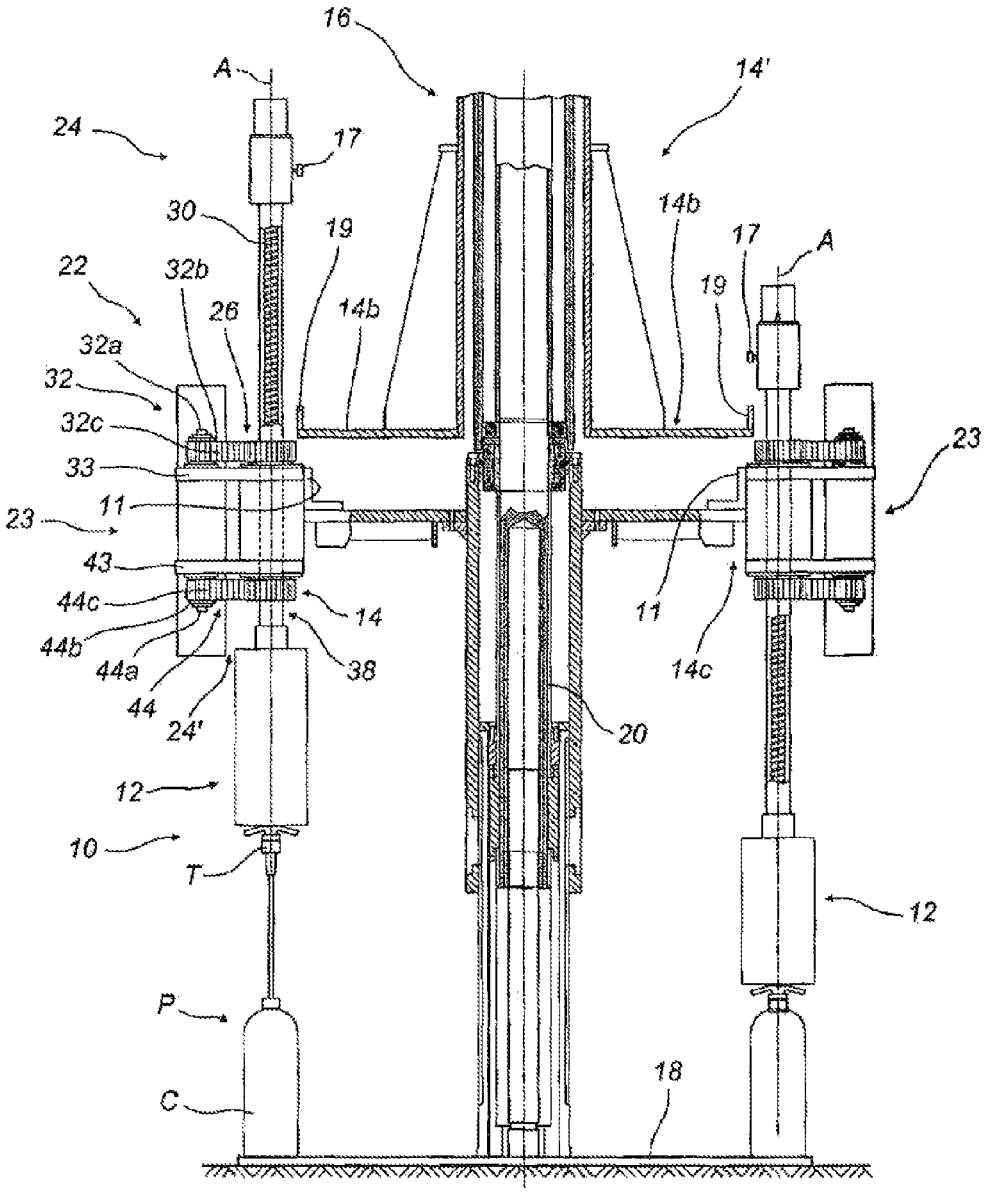

| | | | | |
|---|---|---|---|---|
| 4,535,583 | A * | 8/1985 | Tanaka et al. | 53/75 |
| 5,301,488 | A * | 4/1994 | Ruhl et al. | 53/55 |
| 5,400,564 | A * | 3/1995 | Humphries et al. | 53/75 |
| 5,419,094 | A * | 5/1995 | Vander Bush et al. | 53/75 |
| 6,105,343 | A * | 8/2000 | Grove et al. | 53/490 |
| 6,158,196 | A * | 12/2000 | Trebbi et al. | 53/331.5 |
| 6,804,929 | B2 * | 10/2004 | Kemnitz | 53/75 |
| 7,024,837 | B2 * | 4/2006 | Takebe et al. | 53/490 |
| 7,322,170 | B2 * | 1/2008 | Tomalesky et al. | 53/426 |
| 8,458,992 | B2 * | 6/2013 | Zanini et al. | 53/317 |
| 2006/0272284 | A1 * | 12/2006 | Galimberti et al. | 53/75 |
| 2007/0084152 | A1 * | 4/2007 | Brown | 53/490 |

FOREIGN PATENT DOCUMENTS

| | | | | |
|---|---|---|---|---|
| FR | 2 109 311 AS | | 5/1972 | |
| WO | WO 2009016502 | A1 * | 2/2009 | B67B 3/22 |

* cited by examiner

DEVICE FOR PROCESSING A PRODUCT, COMPRISING AN ELEMENT FOR PROCESSING THE PRODUCT AN APPARATUS FOR MOVING A PROCESSING ELEMENT

CROSS-REFERENCE TO RELATED APPLICATION

This Application is a Section 371 National Stage Application of International Application No. PCT/DE2011/000240, filed Mar. 5, 2011 and published as WO 2011/137882 A1 on Nov. 10, 2011, in Italian, the contents of which are hereby incorporated by reference in their entirety.

The present invention relates to a device for processing a product, comprising an element for processing the product.

The present invention further relates to an apparatus for moving a corresponding processing element.

Devices are known, which are suitable for connecting a closure element, such as a screw closure or a pressure closure, to a container, such as a bottle or flacon. Such devices essentially comprise a carrier frame for the means for feeding a multiplicity of containers, in the form of a turntable, and for the means for feeding the closure element in the form of a frame disposed above the table, which moves together with the table to form a rotatable closure carousel.

The closure devices of the prior art further comprise, per closure head, a vertical shaft, which, at one end, carries the processing element and which is movable vertically over a predefined stroke, which is determined by corresponding drive cams, which act at the other end of the carrier shaft.

In the case of these known devices, the screw fastening of the closure is implemented by means of a rotation, to which the carrier shaft of the processing element is subjected by means of a fulcrum shaft nut, on which is superimposed a grooved profile that is formed on the exterior surface of the carrier shaft. In this case, the axial pressure, which permits the screwing of the closure on the thread of the container, is exerted by the weight of the closure unit, which bears directly on the container, which, if appropriate, was provided with elastic means for cushioning or damping.

A problem that has emerged with respect to the known devices concerns the necessity, as soon as a format change has to be made, to remove and replace the cams, which is associated with difficulties for the responsible personnel and with production time losses, since the exchange of the cams is performed when the machine is stationary.

In the area of closure machines with a rotary carousel, there exists further the need to have a device available that is versatile in use and has a compact form with low space requirement.

There is always generally the need to have an apparatus available, having a processing element in each case that can be used on a processing device in each case and permits much more versatile applicability and/or better operability.

With the present invention, a novel and alternative to the solutions known to date is to be proposed, and in particular one or more of the abovementioned disadvantages and/or problems are to be remedied and/or one or more of the above described needs are to be met.

To this end, a device for processing a product with an element for processing the product is therefore provided, the device being, in particular, suitable for combining a closure element with a container, the device comprising means for receiving, means for feeding the product, and means for feeding the processing element, which is mounted on a corresponding shaft, characterised in that it comprises means that act on the carrier shaft in order to move it in an axial direction and means that act o the shaft to drive the processing element such that it performs processing rotation, the means acting on the shaft being driven in a manner so as to be coordinated with one another.

In this manner, it is possible, in a particularly convenient manner, to achieve a desired mode of functioning for the processing instrument.

Furthermore, an apparatus is provided which can be used in particular on a device for processing a product, which is characterised in that it comprises a receptacle for a carrier shaft of a processing element and for means that act on the carrier shaft in order to move it in an axial direction in order to drive the processing element such that it performs processing rotation, the means acting on the shaft being driven in a manner so as to be coordinated with one another.

Apart from the fact that the present apparatus makes it particularly convenient to achieve a desired mode of operation for the processing element, it further provides a means for forming a modular unit, which, if required, can be connected to a respective device.

Figure 2:
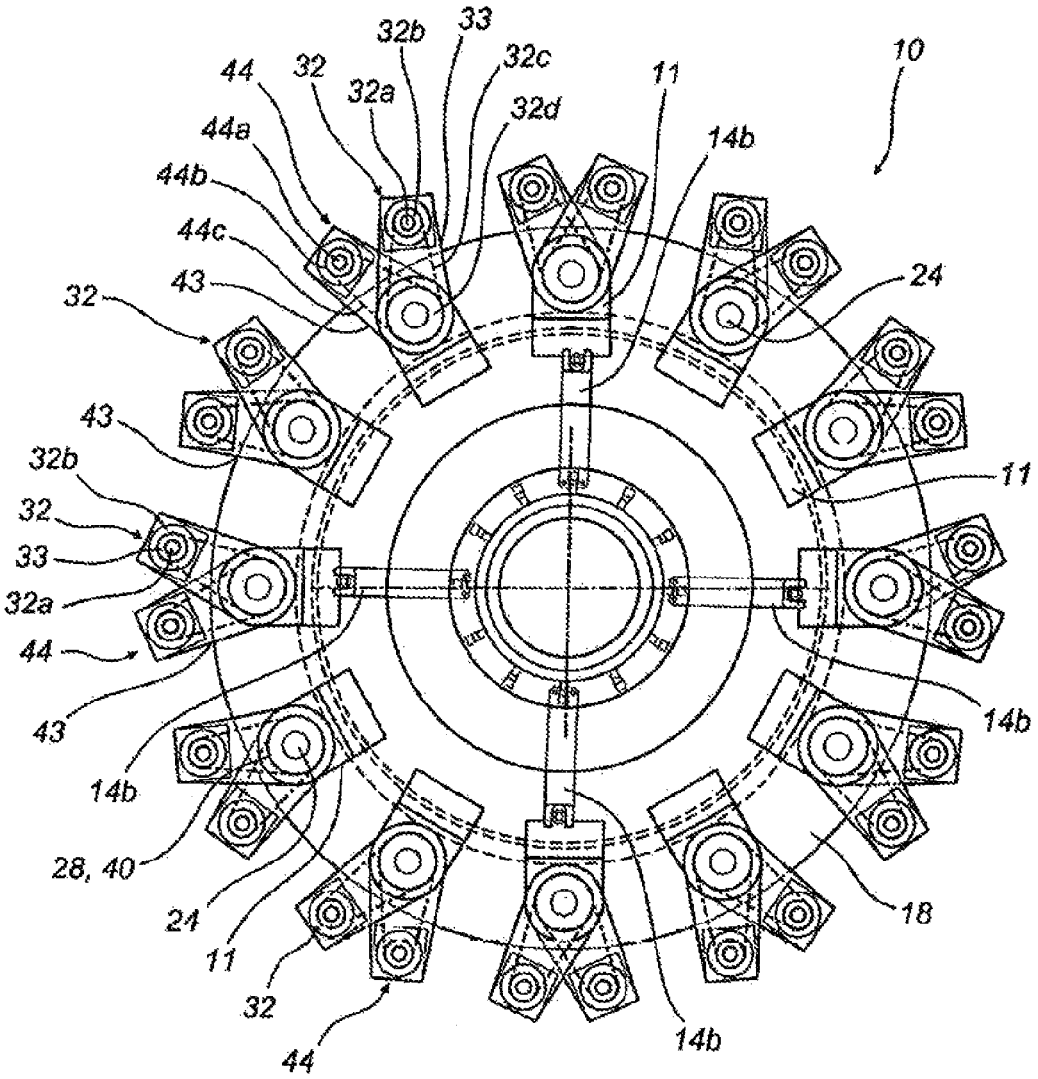
Figure 3:
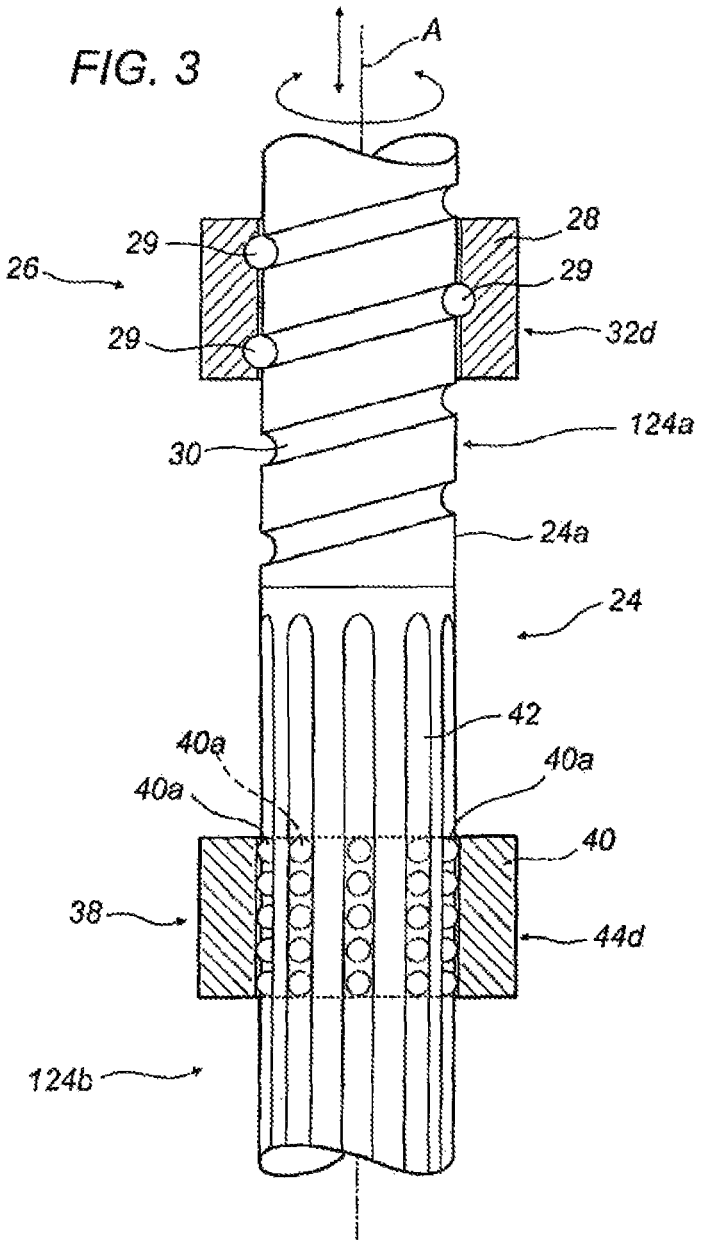
Figure 4:
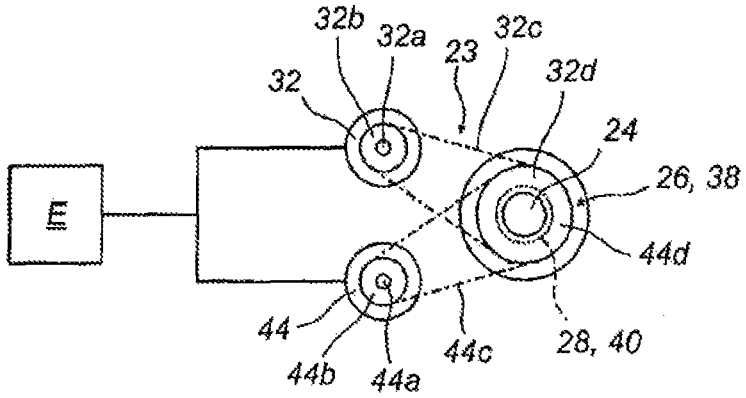

This and further innovative aspects of the invention are in each case disclosed in the following case, the technical features of which, together with corresponding advantages, resulting therefrom, can be taken from the following detailed description, which illustrates a purely exemplary and non-exhaustive embodiment of the invention, and with reference to the accompanying drawings:

FIG. 1 shows a view in vertical section of a preferred embodiment of the device and the apparatus according to the present invention FIG. 2 shows a top view of a preferred embodiment of the device and the apparatus according to the present invention FIG. 3 shows a view in vertical section of a detail of the drive spindle and of the rotation means of the shaft, which carries the processing element, of the present device and of the apparatus corresponding to the present invention;

FIG. 4 shows a block circuit diagram of the system for the control of the apparatus, applicable to a processing head of the present preferred embodiment of the device.

In the accompanying figures, a preferred embodiment of the device 10 for processing a product P is illustrated, which embodiment is in particular suitable for joining a closure element T to a container C in order to form the product P.

The container has in particular the form of a bottle or a flacon. The device has a processing element 12, which is suitable for performing a processing rotation, in particular to screw the closure body T to the container C.

As illustrated, the device has in particular a multiplicity of processing elements 12, which act on a multiplicity of corresponding products P.

As illustrated, the device 10 comprises means 16 for the receiving and means for the feeding of a container C and means 22 for receiving and feed of the processing element 12.

In practice, the receiving means of the machine comprise a fixed frame 12, relative to which the rotatable means for receiving and feeding the product are provided, that is to say for the receiving and feeding of the container C and for the receiving and feeding of the closure element T.

In particular, the means for feeding the container take the form of a rotary table 18, which is suitable for receiving a multiplicity of these containers C, which are distributed such that they circulate around.

As illustrated, the table 18 rotates about a fixed carrier stand 20, together with means for the receiving and feeding of the closure element 12, which is disposed above the table, to form a rotatable closure carousel.

As illustrated, the rotary carousel means 14 comprise a multiplicity of radial carrier arms 14*b* for the processing elements or the closure 12 and are, in each case, driven by a motor for rotation which is not illustrated in the accompanying figures.

In practice, the receptacle 14 for the processing element or the processing elements 12 therefore comprises an arm 14*b* in each case, which extends in the radial direction and comprises, in each case, a radial carrier end 14*c* for the processing element 12.

The device further comprises means or a device 23, which are provided for rotating the processing element 12.

In particular the means, or the device 23, are suitable for moving the processing element 12 between a lowered engagement position and processing position and a raised released position.

In particular the means 23, which are suitable for rotating the processing element, comprise a respective shaft 24, which carries the processing element, and in turn is supported by the radial arm 14*b*.

In practice, the shaft 24 has the form of a vertical shaft, that is to say extends in the vertical direction and, in the region of the lower end 24' carries the processing element 12.

The means, or the device 23, which are suitable for moving the processing element 12, are suitable for moving the processing element in a vertical direction, in particular between a lowered processing position and a raised released position or rest position.

The means, or the apparatus 23, which are suitable for moving the processing element 12, are moreover suitable for setting the processing element into simple rotation in order to effect a corresponding work operating, such as, for example, performing a screwing operation, which connects the closure T to the container C, or a simple orientation of the object T, which is carried by the processing element in order to dispose it in the desired position.

The means, or the apparatus 23, which are suitable for moving the processing element 12, are moreover suitable for setting the processing element into simple rotation in order to perform a rotational displacement, that is to say simultaneously into a rotation and in a vertical displacement, either relative to the product or, as in the present case, relative to the container C.

The means, or the apparatus 23, which are suitable for moving the processing element 12, that is to say the shaft 24, which carries the processing element, comprises means, 26, 28, 30, which act on the shaft in order to move it in an axial direction, and means 38, 40, 42, which act on the shaft, in order to drive the processing element 12 such that it performs processing rotation.

Advantageously it is provided that the means 26, 28, 30, which act on the shaft to move it in an axial direction and the means 38, 40, 42, which act on the shaft to drive the processing element 12 such that it performs processing rotation, are driven in a manner so as to be coordinated with one another to effect a corresponding and desired movement on the part of the carrier shaft 24 and of the corresponding processing element 12.

In particular it is advantageously provided that the means 26, 28, 30, which are suitable for moving the carrier shaft 24 of the processing element in an axial direction, and the means 38, 40, 42, which are suitable for driving the processing element 12 such that it performs processing rotation, act on the carrier shaft 24 of the processing element 12 in a manner so as to be coordinated with one another, such that the carrier shaft 24 is driven for rotation and, preferably, such that a predetermined axial force is exerted and, in particular, such that a predetermined axial force is exerted for screwing the closure T with respect to the container C, as can be better understood from the following description.

In practice, it is advantageously provided that the means 26, 28, 30, which are suitable for moving the carrier shaft 24 of the processing element 12 in an axial direction, and the means 30, 40, 42, which are suitable for driving so as to cause processing rotation, simultaneously act on the carrier shaft 24 or drive it.

In particular, it is advantageously provided that the means 26, 28, 30, which are suitable for moving the carrier shaft 24 of the processing element 12 in an axial direction, and the means 38, 40, 42, which are suitable for driving so as to cause processing rotation, simultaneously act on the carrier shaft 24 or drive it to effect a rotation of the shaft without axial movement.

In particular, the means 26, 28, 30, which are suitable for moving the carrier shaft 24 of the processing element 12 in an axial direction, and the means 38, 40, 42, which are suitable for driving so as to cause processing rotation, simultaneously act on the shaft, to simultaneously effect an axial movement and a rotation of the processing shaft.

This mode of action could be advantageously used to position the processing element 12 vertically or correspondingly in an axial direction with respect to the carrier shaft 24, and simultaneously to rotate it angularly, for example, to orient the part T carried thereby correspondingly.

Corresponding to a further processing mode, it may be provided that the means 26, 28, 30, which are suitable for moving the carrier shaft 24 of the processing element 12 in an axial direction, and the means 38, 40, 42, which are suitable for driving into working rotation, act individually, that is to say not simultaneously, on the processing shaft.

In particular, it may be provided that the means 26, 28, 30, which are suitable for moving the carrier shaft 24 of the processing element 12 in an axial direction, act in order to move the processing element 12 between an engagement position and processing position and a released position and rest position, as is better illustrated below. In this case, the means 38, 40, 42, which are suitable for driving a processing rotation, are locked.

In practice, advantageous means 26 for the spindle drive of the carrier shaft 24 of the processing element 12 are provided.

As can also be readily recognized taking into account FIG. 3, the spindle drive means 26 advantageously comprise a rotatable spindle nut 28, which interacts with a spiral profile 30, with suitable spiral flight, which is provided on the exterior profile 24*a* of the shaft 24, which carries the processing element 12.

The spindle drive means 26 have, in particular, the form of a recirculating ball spindle, of which the balls are designated in FIG. 3 with the reference number 29. The balls run between grooves, which are provided on the cylindrical inner side of the spindle nut 28, and the spiral grooves 30 of the spindle drive means for the vertical movement of the shaft 24.

Means 32 are provide for driving the spindle drive means such that it rotates.

The means 32 for driving the spindle drive means such that it rotates are suitable for driving the spindle nut 28 of the spindle drive means such that it rotates in an angular direction or in an opposite angular direction. In this manner, it is possible, in a particularly convenient manner, to effect the raising or lowering of the shaft bearing the processing element 12.

The means 32 for driving the spindle drive means such that it rotates have the form of an electrical drive in each case, having a shaft in each case, which extends upwardly, the electrical drive preferably taking the form of a brushless drive.

In practice, the drive 32 has a shaft 32*a* in each case, which carries a pulley 32*b* in each case and which is operationally connected to the spindle nut 28 of the spindle drive via a belt 32*c*, which, in each case, is connected to a pulley 32*b*, which is designed so as to be outside or integral with the spindle nut 28 of the spindle drive. In particular, the pulley, or the teeth 32*d* thereof, can be designed so as to be outside or integral with the spindle nut 28, that is to say firmly connected thereto.

The means 38, which are suitable for driving the shaft 24, which carries the processing element 12, such that it rotates, in turn have the form of an element, or spindle nut, 40 in engagement with at least one corresponding longitudinally oriented groove 42, which is provided on the outer profile 24*a* of the carrier shaft 24.

The engagement element or the spindle nut 40 has a multiplicity of radial engagement means 40*a*, which interact with a multiplicity of longitudinally oriented and parallel grooves 42, which are provided on the outer profile of the carrier shaft.

The radial engagement means have the form of balls 40*a*, which run around between, in each case, longitudinally oriented grooves of the spindle nut and corresponding longitudinally oriented and parallel grooves 42, which are provided on the outer profile of the shaft 24, which carries the processing element 12.

In practice, it permits the connection between the spindle nut 40 and the longitudinally oriented grooves 42 of the shaft 24 to be displaced in a vertical direction.

In practice, the carrier shaft 24, which runs with its longitudinally oriented grooves 42 on the balls of the spindle nut 40, can move in a vertical direction in a direction that is formed by the axis A of the carrier shaft 24. This is performed in particular when the rotation of the spindle nut 40 in each case is blocked and, on the other hand, the spindle nut 28 of the spindle drive means is driven such that it rotates.

Means 44 are provided, which are suitable for driving the means 40 for rotation of the shaft bearing the processing element 12.

In particular, the drive means of the means 40 for the rotation of the shaft, which carries the processing element 12, comprise a respective electrical drive 44, which in particular has the form of a brushless drive.

Means 44 are provided, which are suitable for moving the means 40 for rotation of the shaft bearing the processing element are in particular suitable for driving the spindle nut 40 in each case for rotation in a particular angular direction.

As can be seen in particular from FIG. 4, the drive motor 44 of the rotation means, in particular for drive of the spindle nut 40, has a vertical shaft 44*a* in each case, which is oriented downwards and carries a pulley 44*b* in each case, which is operationally connected via a belt 44*c* in each case to a corresponding pulley 44*d*, which is provided on the spindle nut 40, in particular outside thereof, that is to say on a pulley, which is firmly connected to the spindle nut 40.

Advantageously it is provided that the spiral groove 30 of the spindle drive means and, in each case, the longitudinally oriented groove 42 of the rotation means are provided on the carrier shaft 14 in positions proximate to one another.

The spiral groove 30 of the spindle drive means is preferably disposed above the, in each case, longitudinally oriented groove 42 of the rotation means.

According to another embodiment, the spiral groove 30 of the spindle drive means, however, is also disposed below the, in each case, longitudinally oriented groove 42 of the rotation means.

Furthermore, it would be conceivable, to the advantage of the space taken up by the present apparatus for the spiral groove 30 of the spindle drive means to extend on the side of the profile of the shaft, on which, furthermore, the longitudinally oriented groove 42 of the rotation means is present; in this case, the grooves 30 and 42 would be in the same region of the shaft.

Advantageously it is provided that the spiral groove 30 of the spindle drive means and, in each case, the longitudinally oriented groove 42 of the rotation means are provided on the carrier shaft 14 by means of the fastening of two corresponding carrier sections 124*a*, 124*b*, which carry the groove 30 or 42 as appropriate.

The spindle nuts 28 and 40, the spindle drive means and/or the rotation means are mounted coaxially outside the carrier shaft 24.

As illustrated in FIG. 4, control means E are provided, which are suitable for controlling the rotation, in particular the rotational speed of the spindle nut 28 of the spindle for the axial movement of the carrier shaft of the processing element and the rotational speed of the spindle nut 40 for the rotation of the shaft by controlling the drive motors 32 and 44 in each case, to which the control means E are correspondingly connected.

These control means have the form of a corresponding electronic computer, which may be formed by a PC or a CPU or the like, and which controls the internal mode of operation of the present device.

The electronic control means E are in particular suitable, in a manner so as to be coordinated with one another, for controlling the rotations of the spindle nut 28 of the means, which are suitable for moving the carrier shaft 24 in an axial direction, and of the spindle nuts 40 of the means, which are suitable for driving the shaft 24 or the processing element 12 such that it performs processing rotation.

In particular, the electronic control means E comprise the following operating modes.

Corresponding to a first mode, it is possible for the spindle nut 28, of the means 26, which are suitable for moving the carrier shaft 24 of the processing element 12 in an axial direction, and the spindle nuts 40, of the means 38, which are suitable for driving the processing element 12 such that it performs processing rotation, to be driven such that they rotate simultaneously.

In particular, it is possible for the spindle nut 28, of the means 26, which are suitable for moving the carrier shaft 24 of the processing element 12 in an axial direction, and the spindle nuts 40, of the means 38, which are suitable for driving the processing element 12 such that it performs processing rotation, to be driven such that they rotate with the same speed, such that they drive the carrier shaft 24 such that it rotates.

In practice, the drive means in each case can drive the spindle nut 28 of the spindles 26 such that it rotates, and the spindle nut 40 of the groove-shaped profile 42 such that it rotates with the same rotational speed and in the same direction, wherein a simple rotation of the processing shaft is effected without axial forward or backward movement.

In this manner, for example, the closure T can be screwed on the container C.

Furthermore, it is possible for the spindle nut 28, of the means 26, which are suitable for moving the carrier shaft 24 of the processing element 12 in an axial direction, and the spindle nut 40, of the means 38, which are suitable for driving the processing element 12 such that it performs processing rotation, to be driven in rotation such that they rotate in a manner so as to be coordinated with one another, such that they drive the carrier shaft 24 such that it rotates and such that they exert a predetermined axial force.

In this manner, for example, the screwing of the closure T onto the container C can take place with greater efficiency.

Thanks to the present apparatus it is in particular possible to exert a correspondingly controlled axial force onto the container. In practice, the axial pressure, which is exerted on the container, can be recognised or determined and, if needed, changed corresponding to the particular requirements, that is to say according to a desired mode.

Furthermore, it is possible for the spindle nut 28, of the means 26, which are suitable for moving the carrier shaft 24 of the processing element 12 in an axial direction, and the spindle nut 40, of the means 38, which are suitable for driving the processing element 12 such that it performs processing rotation, to be driven such that they rotate simultaneously and effect an axial movement and a rotation of the processing shaft.

In practice, it is possible for the respective drive means to drive the spindle nut 28 of the spindle in an angular direction or in an opposite angular direction, and the spindle nut 40 of the groove-shaped profile, such that it rotates with different rotational speeds, whereby a rotation of the carrier shaft 24 is effected with simultaneous axial forward or backward movement of the carrier shaft 24.

Furthermore, it is possible for the spindle nut 28, of the means 26, which are suitable for moving the carrier shaft 24 of the processing element 12 in an axial direction, and the spindle nut 40, of the means 38, which are suitable for driving the processing element 12 such that it performs processing rotation, to be driven such that they rotate individually or separately.

To move the processing element 12 between an engagement position and processing position and a released position and rest position, the spindle nut 28 of the means 26, which are suitable for moving the carrier shaft 24 of the processing element 12 in an axial direction is driven such that it rotates and the spindle nut 40, of the means 38, which are suitable for driving the processing element 12 such that it performs processing rotation, to be kept locked or substantially locked.

The present control means can thus drive the spindle nut 28 of the spindle 26 in an angular direction or in an opposite angular direction and keep the spindle nut 38 of the groove-shaped profile of the drive locked in rotation, whereby an axial forward or backward movement of the carrier shaft, that is to say the raising or lowering of the processing element 12 is effected.

Corresponding to a further mode, it would further be possible for this control means to keep the spindle nut 28 of the spindle locked and drive the spindle nut 40 of the groove-shaped profile such that it rotates, whereby a rotation with an extensive axial displacement of the processing shaft is effected, in forward or backward movement depending on the angular direction that is imposed on the spindle nut 40.

The use of brushless drives further permits the control means E to determine the axial pressure that the processing element 12 exerts on the product or the container C, and the torque that the processing element exerts on the product, that is to say the closure T during screwing onto the container. In practice, means for determining the axial pressure that the processing element 12 exerts on the product or the container C, and means for determining the torque that the processing element 12 exerts on the product, that is to say the closure T during screwing onto the container are provided.

The control means may further form means for limiting the axial pressure, which the processing element 12 exerts on the product or on the container C, to a predefined maximum value.

The control means may further form means for limiting the torque, which the processing element on the product, that is to say on the closure T, during screwing onto the container C, to a predefined maximum value.

As illustrated, a holder 11 for the apparatus 24, 26, 38 for the drive of the processing element 12 is provided.

The holder 11 takes the form of a stirrup, which is mounted on the rotary carousel 16 and is in particular held by a radial arm 14*d* of the latter.

Furthermore, the holder 11 can advantageously be in engagement with the device and released by it such that it is possible to remove the entire apparatus 24, 26, 38, for moving the processing element, from the device or to install it thereon.

As illustrated, means 33 are further provided for the holder of the drive means 32 for the means for axial movement of the carrier shaft 24, which have the form of a stirrup 33, which extends in a radial direction relative to the carousel, that is to say to the shaft 24.

In particular, the means 33 for the holder of the drive means 32 for the means for the axial movement of the carrier shaft 24 is carried by a fastening holder 11.

In practice, the means or the stirrup 33 are firmly connected to the holder 11, by means of which they are fastened on the device, in particular on the rotary carousel thereof.

Furthermore, means 43 for the holder of the drive means 44 for the means 38 for rotation of the shaft 24, which carries the processing element 12, are provided.

These means for the holder of the drive means 44, too, have the form of a stirrup 43 in each case, which extends in a radial direction relative to the carousel, that is to say to the shaft 24.

In practice, the means 43 for the holder of the drive means 44 for the means for rotation of the shaft 24, which carries the processing element 12, are carried by the fastening holder 11, by means of which they are fastened on the device, in particular on the rotary carousel thereof.

As illustrated, the stirrup 33 for the holder of the drive means 32 for the spindle drive means 26 and the stirrup 43 for the holder of the drive means 44 for the means for rotation of the shaft 24 extend from that region in which a shaft 24 in each case is provided, wherein they define a respective angle between one another. In particular, the angle between the stirrup 33 for the holder of the drive means 32 for the spindle drive means 26 and the stirrup 43 for the holder of the drive means 44 for that of the means for rotation of the shaft 24 is smaller than 90°.

In practice, the stirrup 33 for the holder of the drive means 32 for the means for the rotational drive of the carrier shaft in a radial direction extends in the direction of the exterior of the device, just as the stirrup 43 for the holder of the drive means 44, which also extends in a radial direction in the direction of the exterior of the device.

In this manner, it was possible to dispose the drive means 32 and 44 advantageously in an arrangement that is particularly compact and convenient for the assembly and maintenance.

With the present apparatus it is thus advantageously possible automatically to adjust the position of the processing element, and thereby avoid the use of conventional cams, as is provided in the devices of the prior art.

Furthermore, an apparatus was provided, which, in particular in the case of a device which can be used for processing a product P, such as the above-described closure device, which comprises a holder 11 for a carrier shaft 24 of a processing element 12 and for means 26, 28, 30, which act on the carrier shaft 24, in order to move them in an axial direction, and for means 38, 40, 42, which act on the shaft in order to drive the processing element 12 in rotation, wherein the means 26, 28, 30; 38, 40, 42 are driven in a manner so as to be coordinated with one another.

The present apparatus 24, 26, 38 thus forms a modular unit, which on demand can be connected to a device in each case and which can be thus correspondingly set up and swapped in, for example as replacement for an analogue unit, which is to be subjected to maintenance or repair.

As illustrated, means are provided for drop safety of the processing element 12 to prevent that, for cases in which a hold-back action exerted by the drives that move the shaft should fail, the processing element cannot strike against a surface and cause damage.

As illustrated, the securing means comprise an engagement element 17 in each case, which is connected to the carrier shaft and is connected to a securing element, which is connected to the frame, in particular to the radial carrier arm 14*b*.

The invention, in this embodiment, is obviously suitable for an industrial application. For the person skilled in the art in this field, a multiplicity of variants and/or changes are furthermore conceivable, which can be made to the invention which is represented in the specifically preferred embodiment without leaving the framework of the concept of the invention that is described in detail. In particular, a person skilled in the art can easily conceive of further preferred embodiments of the invention, which contain one or more of the features presented above. Furthermore, it goes without saying that all details can be replaced by technically equivalent elements.

The invention claimed is:

1. A device for processing a product with a processing element for processing the product, the device being suitable for combining a closure element with a container, the device comprising containing means for receiving and means for feeding the product, and means for feeding the processing element, the processing element is mounted on a corresponding carrier shaft, wherein the device comprises spindle drive means that act on the carrier shaft in order to move it in an axial direction, each of the spindle drive means including a rotatable spindle nut that interacts with a spiral groove provided on an outer side of the carrier shaft, and rotary means that drive rotation of the carrier shaft to drive the processing element such that it performs a processing rotation, each of the rotary means including a rotatable spindle nut that engages a longitudinally directed groove on the outer side of the carrier shaft, wherein the spindle drive means and the rotary means drive the carrier shaft simultaneously in rotation and translation, and wherein the spiral groove of the spindle drive means and the longitudinally directed groove of the rotary means are on the same region of the shaft.

2. The device according to claim 1, wherein the spindle drive means and the rotary means drive rotation of the carrier shaft.

3. The device according to claim 1, wherein the spindle drive means and the rotary means drive rotation of the carrier shaft and exert a predetermined axial force on the carrier shaft.

4. The device according to claim 1, wherein the spindle drive means and the rotary means act simultaneously on the carrier shaft to effect an axial movement and a rotation of the carrier shaft.

5. The device according to claim 1, wherein the spindle drive means and the rotary means act individually on the carrier shaft.

6. The device according to claim 1, wherein the spindle drive means is configured to move the carrier shaft of the processing element in an axial direction to move the processing element between an engagement position, a processing position, a released position and a resting position.

7. The device according to claim 1, wherein the spindle drive means have the form of a recirculating ball spindle.

8. The device according to claim 1, including drive means for driving the spindle drive means, which are suitable for moving the carrier shaft in an axial direction to receive the processing element.

9. The device according to claim 8, wherein the drive means for driving the spindle drive means drive each of the spindle nuts of the spindle drive means such that it rotates in an angular direction or in an opposite angular direction.

10. The device according to claim 9, wherein the drive means for driving the spindle drive means are suitable for driving each of the spindle nuts of the spindle drive means such that it rotates in an angular direction or in an opposite angular direction to drive the upward movement or the downward movement of the carrier shaft, which carries the processing element.

11. The device according to claim 8, the drive means includes a motor.

12. The device according to claim 11, wherein the motor includes a brushless drive.

13. The device according to claim 11, wherein the motor includes a shaft, which is operationally connected to the spindle nut of the spindle drive means.

14. The device according to claim 8, including a holder for each of the drive means for driving the spindle drive means.

15. The device according to claim 14, wherein each of the holders of the drive means for driving the spindle drive means includes a stirrup.

16. The device according to claim 15, wherein the stirrup of each holder of the drive means for driving the spindle drive means extends in a radial direction from the carrier shaft.

17. The device according to claim 14, wherein each of the holders of the drive means for driving the spindle drive means are carried by a fastening holder.

18. The device according to claim 1, wherein the spindle nut of the rotary means interacts with balls, which in turn interact with a multiplicity of longitudinally oriented and parallel grooves, which are provided on the outer side of the carrier shaft.

19. The device according to claim 1, including drive means for driving the rotary means.

20. The device according to claim 19, wherein the drive means for driving the rotary means moves each of the spindle nuts of the rotary means.

21. The device according to claim 20, wherein the drive means for driving the rotary means comprise a motor having brushless drive.

22. The device according to claim 21, wherein the motor comprises a shaft, which is operationally connected to the spindle nuts of the rotary means.

23. The device according to claim 19, including a holder for each of the drive means for driving the rotary means.

24. The device according to claim 23, wherein each of the holders of the drive means for driving the rotary means includes a stirrup.

25. The device according to claim 24, wherein the stirrup of each holder of the drive means for driving the rotary means extends in a radial direction from the carrier shaft.

26. The device according to claim 25, wherein the stirrup of each holder of the drive means for driving the rotary means extends at an angle to a stirrup of a corresponding holder for drive means for driving the spindle drive means.

27. The device according to claim 23, wherein each of the holders of the drive means for driving the rotary means are carried by the fastening holder.

28. The device according to claim 1, wherein the spindle nuts, of the spindle drive means and the spindle nuts of the rotary means are driven such that they rotate simultaneously.

29. The device according to claim 1, wherein the spindle nuts of the spindle drive means and the spindle nuts of the rotary means are driven such that they rotate with the same speed, such that they drive the carrier shaft such that it rotates.

30. The device according to claim 1, wherein the spindle nuts of the spindle drive means and the spindle nuts of the rotary means are driven such that they rotate in a manner so as to be coordinated with one another drive the carrier shaft such that the carrier shaft rotates, and exert a predetermined axial force on the carrier shaft.

31. The device according to claim 1, wherein the spindle nuts of the spindle drive means and the spindle nuts of the rotary means are driven such that they rotate in a manner so as to be coordinated with one another, and effect an axial movement and a rotation of the carrier shaft.

32. The device according to claim 1, wherein the spindle nuts of the spindle drive means and the spindle nuts of the rotary means are driven such that they rotate individually.

33. The device according to claim 1, wherein for moving the processing element between an engagement position and processing position and a released position and rest position, each of the spindle nuts of the spindle drive means is driven such that it rotates and each of the spindle nuts of the rotary means are kept locked or substantially locked.

34. The device according to claim 1, wherein the spiral groove is disposed above or below the respective longitudinally oriented groove, and extends into a portion of the profile of the carrier shaft in which the longitudinally oriented groove is present.

35. The device according to claim 1, wherein the spiral groove and the respective longitudinally oriented groove are provided by means of the fastening of corresponding carrier sections.

36. The device according to claim 1, including a holder for receiving the spindle drive means and the rotary means.

37. The device according to claim 36, wherein the holder is mounted on a rotatable carousel of the device.

38. The device according to claim 36, wherein the holder is configured for detachment from the rotatable carousel.

39. The device according to claim 1, characterized in that the means for the feed of a product have the form of a movable table, which is suitable for carrying a multiplicity of containers, which are arranged such that they circulate around the table.

40. The device according to claim 1, wherein each of the means for feeding the process element are suitable for moving in harmony with the product.

41. The device according to claim 1, wherein each of the means for feeding the processing element are configured to move the processing element in a vertical direction between a lowered position and a raised position.

42. The device according to claim 1, wherein the carrier shaft extends in a vertical direction.

43. The device according to claim 1, wherein the carrier shaft carries, in the region of a lower end, the processing element and is carried by a radial arm.

44. The device according to claim 1, comprising electronic control means.

45. The device according to claim 1, comprising means for determining an axial pressure that the processing element exerts on the product.

46. The device according to claim 1, comprising means for determining a torque that the processing element exerts on the product.

47. The device according to claim 1, comprising means for limiting an axial pressure that the processing element exerts on the product to a predetermined maximum value.

48. The device according to claim 1, comprising means for limiting a torque, which the processing element exerts on the product.

49. The device according to claim 1, comprising means for blocking the processing element from being lowered.

* * * * *